United States Patent [19]

Campbell

[11] Patent Number: 4,570,454

[45] Date of Patent: Feb. 18, 1986

[54] DRINKING MUG

[76] Inventor: Loyal E. Campbell, 2075 Fisher St., Huntsville, Ala. 35803

[21] Appl. No.: 676,081

[22] Filed: Nov. 29, 1984

Related U.S. Application Data

[63] Continuation-in-part of Ser. No. 528,632, Sep. 1, 1983, Pat. No. 4,485,637, which is a continuation-in-part of Ser. No. 345,035, Feb. 2, 1982, Pat. No. 4,402,195.

[51] Int. Cl.[4] ..... F25D 3/08

[52] U.S. Cl. ..... 62/457; 62/529; 215/13 R

[58] Field of Search ..... 62/457, 529, 371, 372, 62/530, 458, 459, 463, 464, 465, 125, 531, 430, 438; 215/13 R

[56] References Cited

U.S. PATENT DOCUMENTS 3,205,678 9/1965 Stoner ..... 62/457
3,715,895 2/1973 Devlin ..... 62/457
4,402,195 9/1983 Campbell ..... 62/457
4,485,637 12/1984 Campbell ..... 62/457

*Primary Examiner*—Lloyd L. King
*Attorney, Agent, or Firm*—C. A. Phillips; Michael L. Hoelter

[57] ABSTRACT

A double-walled drinking vessel having a heat maintenance chamber between an inner wall and outer, transparent, wall of the vessel. A fluid is placed between the walls, and this fluid is either heated or cooled, depending upon the beverage that is to be employed in the vessel. An annular base in the form of a skirt is placed around and below the bottom of the vessel, and it has a plurality of spaced orifices which provides for air circulation underneath the vessel, this preventing condensation from occurring on a tabletop or other supporting surface. The state of the temperature maintenance chamber is viewable through the transparent outer wall.

9 Claims, 26 Drawing Figures

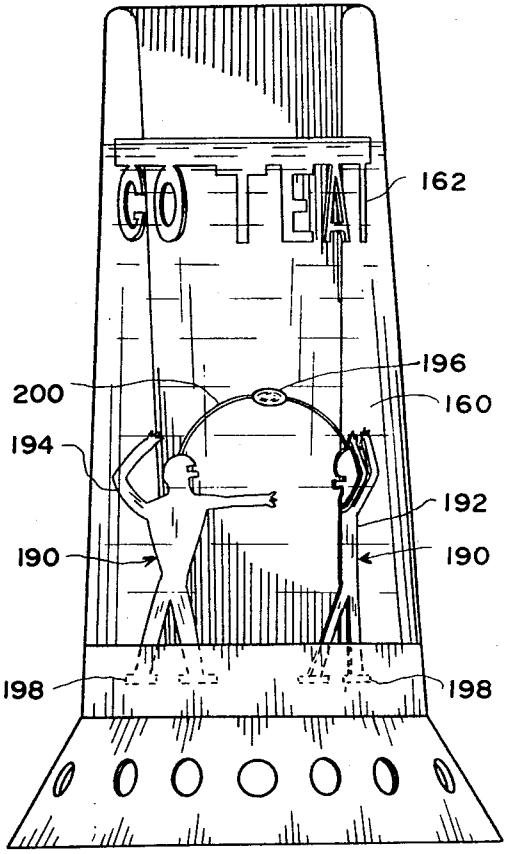
FIG. 9
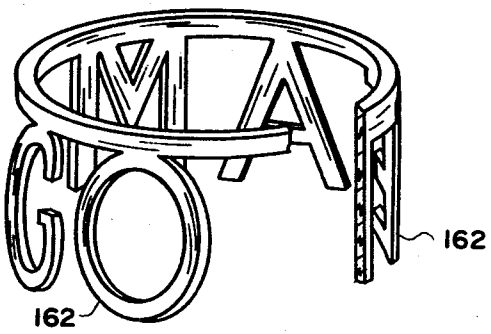
FIG. 10
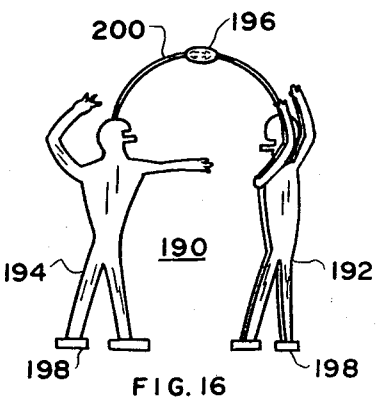
FIG. 16
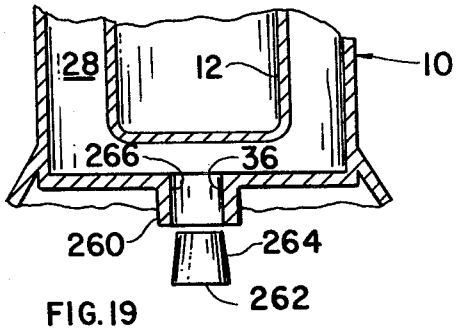
FIG. 19
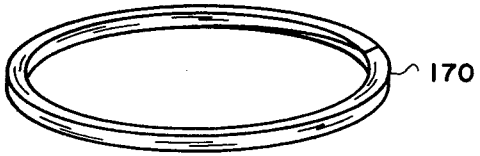
FIG. 11
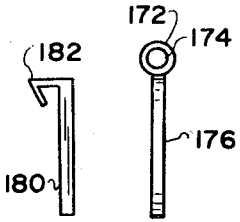
FIG. 13
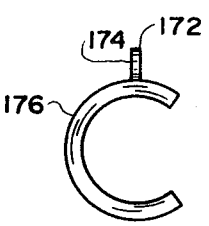
FIG. 12
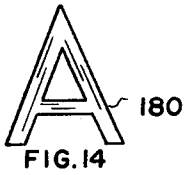
FIG. 14
FIG. 15

DRINKING MUG

CROSS REFERENCE OF RELATED APPLICATION

This application is a continuation-in-part of application Ser. No. 528,632, filed Sept. 1, 1983, issued as U.S. Pat. No. 4,485,637, which is a continuation-in-part of application Ser. No. 345,035, filed Feb. 2, 1982, issued as U.S. Pat. No. 4,402,195.

TECHNICAL FIELD

This invention relates generally to drinking vessels, and more particularly to a vessel of this character wherein there is provided a heat maintenance chamber between an inner and outer wall of the vessel.

BACKGROUND ART

There are available many devices designed to keep a cold beverage cold that involve some type of sealed insulating chamber containing a refrigerant fluid. While these devices are adequate for keeping a beverage cool, they usually are not able to keep a beverage hot due to either the type of refrigerant sealed within the insulating chamber or the inability to heat the sealed refrigerant without damaging the device as a whole. Furthermore, even though the refrigerant fluid may be removable as indicated by prior art, the user is still unable to determine when the cooling property of the removable refrigerant has been exhausted.

Additionally, whether a cooling or warming device is desired, the difference in temperature between ambient room temperature and this device will cause condensation to form on the drinking vessel, which builds up on the surface the vessel is resting upon. Some devices attempt to collect and store this condensate, but when the drinking vessel is tilted upward to remove the last of the insulated beverage, the stored condensate leaks out unexpectedly onto the user and/or the supporting surface.

It is an object of this invention to be adaptable at keeping a beverage cool as well as keeping a beverage warm, depending upon the user's requirements. It is also an object of this invention to eliminate any condensate build-up from occurring on the supporting surface or dripping onto the user.

SUMMARY OF THE INVENTION

In accordance with the present invention, a sealed doublewalled drinking vessel is constructed wherein inner and outer walls enclose an insulating or heat temperature maintenance chamber therebetween. A sealable opening is provided in the central portion of the bottom of the vessel opening into the temperature maintenance chamber through which a liquid of a desired temperature is supplied. For example, hot or boiling water may be poured into the chamber. Alternately, water or other fluid may be placed in the temperature maintenance chamber and frozen. A beverage enclosed by the inner wall of the vessel is maintained for an appreciable time under a desired temperature. The outer wall is made transparent so that the state of a fluid, particularly if frozen or partially frozen, may be monitored. An annular skirt surrounds and extends below the lower or bottom edge of the vessel and supports it. This skirt has a plurality of spaced orifices that enable air flow around and underneath the vessel, these orifices and the resultant air flow preventing any condensation from collecting on the skirt and then running on down to such surface as the vessel might be placed on.

BRIEF DESCRIPTION OF THE DRAWINGS

FIG. 9 is an elevational view of an alternate form of the invention particularly illustrating two distinctive sets of figures placed in the cavity between the inner and outer walls of a vessel.

FIG. 10 is a pictorial view illustrating the top figure shown within the cavity of the vessel shown in FIG. 9.

FIG. 11 is a pictorial view illustrating a supporting ring for holding figures within a cavity of the vessel.

FIG. 12 is an elevational view of a letter-shaped figure with a support adapted to be placed on a supporting ring shown in FIG. 11.

FIG. 13 is a view of a right angle to the view shown in FIG. 12.

FIG. 14 is a front elevational view of a letter figure having an alternate form of support to that shown in FIG. 13.

FIG. 15 is a view at a right angle to the view shown in FIG. 14.

FIG. 16 is a pictorial view of the figure shown in the lower portion of FIG. 9.

FIG. 19 is a broken away view showing an alternate method of sealing this drinking vessel.

FIG. 25 is a pictorial view, partially broken away, of the top.

FIG. 26 is a pictorial view, partially broken away, of an alternate top.

DETAILED DESCRIPTION OF THE DRAWINGS

Figure 2:
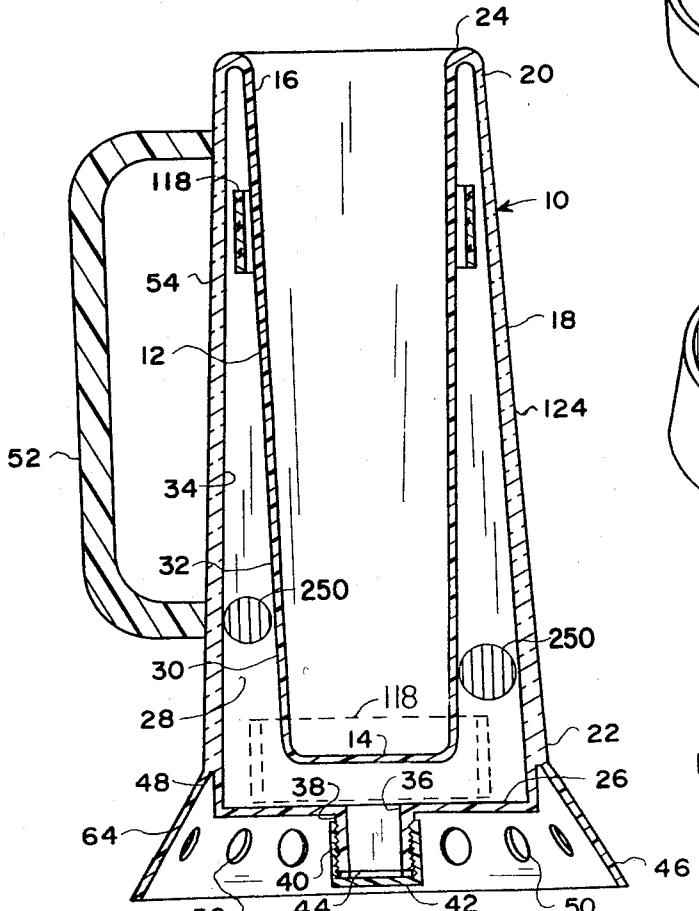
FIG. 2 is a sectional view taken along line 2—2 of FIG. 1.
Figure 1:
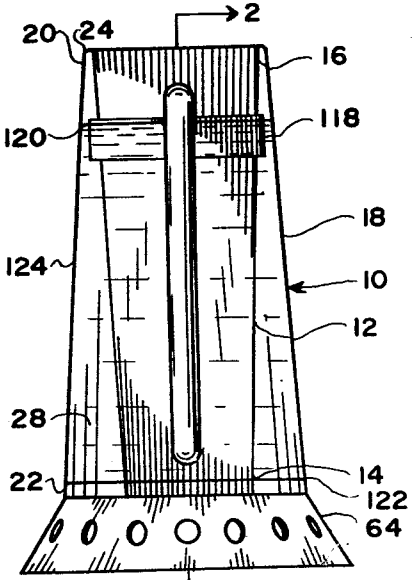
FIG. 1 is an elevational view of a drinking vessel as contemplated by the present invention.

Referring to FIGS. 1 and 2, there is shown a drinking vessel 10 basically formed of an inner drinking tumbler 12 which is tapered with a smaller diameter at its base 14 than at its top 16. Surrounding and spaced from it is an outer container 18 which has an opposite taper, having a smaller diameter at its top 20 and larger diameter at its bottom 22. Tumbler 12 and outer container 18 are sealably connected together by an interconnecting annular enclosure region 24. The bottom 14 of tumbler 12 is spaced from the interior bottom surface 26 of outer container 18, whereby there is a continuous open volume or cavity 28 around the sides 30 and bottom 14 of tumbler 12 created by the outer wall 32 of tumbler 12 and inner wall 34 of container 18.

An opening 36 is centrally positioned in the bottom of container 18, and a neck or collar member 38 surrounds this opening and extends below it. The outer surface 40 of this collar or neck region is threaded, and a threaded cap 42 threadably screws on collar 38 to effect closure of it, sealing of the closure being effected by means of a closing sealing gasket 44.

A supporting base or skirt 46 extends from an indented edge 48 in the side wall of container 18. This base or skirt extends downward and outward to provide an increased support for the vessel. As one feature of the invention, skirt 46 includes a plurality of spaced openings 50 extending around it to provide means for enabling air flow in and out of the base, which would otherwise be closed by this skirt resting on a supporting surface. The vertical dimension of skirt 46 is such as to hold vessel 10 at an elevation such that cap 42 will be held just above the supported surface and preventing it from resting on the surface, and also permitting an area for air flow to pass over the bottom surface of cap 42. Air flow within the skirt cavity and under cap 42 prevents condensation from forming on the skirt and cap, which has been found will otherwise occur and will run down on the supporting surface holding the vessel. Of course, this is quite important in preventing damage to furniture upon which the vessel might be placed. A conventional handle 52 attaches to the outside of outer container wall 54 of vessel 10 in a conventional manner.

Figure 4:
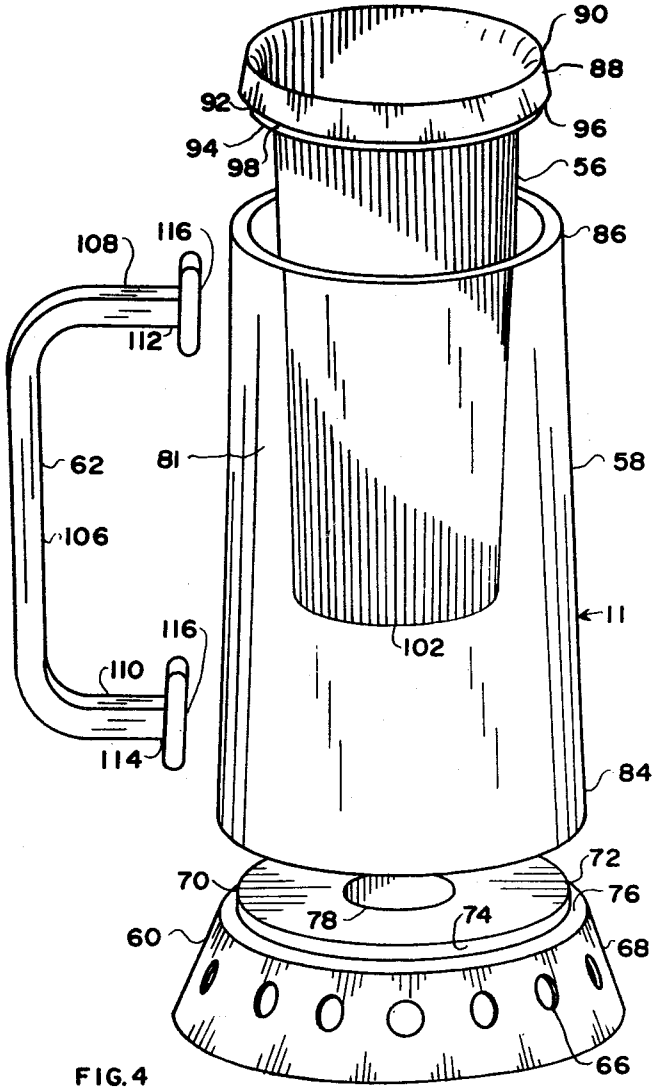
FIG. 4 is a partially exploded pictorial view illustrating components used to manufacture a drinking vessel as shown in FIG. 1.

FIG. 4 illustrates the construction of a drinking vessel 11 from discrete components, and, as shown, these components are: drinking tumbler unit 56, outer cylinder unit 58, base unit 60, and handle unit 62. Base unit 60 is configured like the lower portion 64 of drinking vessel 10 as shown in FIGS. 1 and 2. Thus, base unit 60 includes a series of openings 66 positioned around a skirt 68. A circular groove 70 extends around an upper side 74 of base unit 60, this groove being formed with a side wall 74 and bottom side or floor 76. A central opening 78 in base 60 provides access through the base via a filling neck (not shown) corresponding to collar or neck member 38 in FIG. 2. Typically, base unit 60 would be constructed of an opaque plastic material to thus block the viewing of the filling neck and to provide a more conventional overall appearance for drinking vessel 11.

Outer cylinder unit 58 is constructed of a transparent plastic material and typically is tapered to have a larger diameter at its bottom 84 than at its top 86. The inner diameter side of bottom 84 is dimensioned to closely fit over wall 74 of base 60 and be attached in this position by conventional means, such as by a plastic weld or by glue.

Drinking tumbler unit 56 is typically constructed of a transparent (either clear or tinted) plastic material. It has an enlarged collar region 88 around its upper end 90, and there is a groove 92 around the lower edge 94 of collar 88 formed by a ceiling surface 96 and a side wall surface 98. Side wall surface 98 has a circular dimension which is essentially the same as the inner diameter region 86 of the top of outer cylinder unit 58, and drinking tumbler unit 56 is attached to outer cylinder 58 by placing these surfaces together. The surfaces are secured to effect a seal, as by plastic welding or by gluing. In order to effect a desired volume in fluid chamber 81 between drinking tumbler unit 56 and outer cylinder unit 58, drinking tumbler unit 56 may be tapered (as shown) wherein the bottom 102 of drinking tumbler unit 56 is of smaller diameter than its upper end 90.

Handle unit 62 is typically formed of an opaque, or transparent, plastic material and is generally conventional in configuration having a vertical gripping region 106 and upper and lower generally horizontal arms 108 and 110, respectively. End regions 112 and 114, respectively, of the arms are enlarged to facilitate gluing or other forms of attachment to outer cylinder unit 58. Since outer cylinder unit 58 has a smaller diameter upper region than the lower region, in order to preserve a perpendicular relation between the plane of the bottom of drinking vessel 11 and gripping region 106 of handle unit 62, upper arm 108 is made appropriately longer than lower arm 110.

As one feature of the invention, an annular collar 118 (FIGS. 1-3) surrounds tumbler 12 within cavity 28, and it is constructed of a floatable material. As an example of its function, a fluid 120, such as water, is placed in cavity 28. This is accomplished by first removing cap 42, then turning the vessel upside down, and finally, pouring the water through opening 36 until filled up to filling mark 122, and then replacing cap 42. Vessel 20 is then placed in a freezer compartment of a refrigerator (or simply in a freezer) in the upside down position wherein floatable ring 118 would be in the lower portion of the vessel, its position being illustrated by dashed lines 120 in FIG. 2. Room for expansion within cavity 28 as freezing occurs is provided for by the unfilled portion of the cavity provided by the limited filling as described. When the water in cavity 28 is frozen, vessel 10 would be ready for use, and typically, a user would then pour a beverage to be chilled or maintained in a chilled condition into tumbler 12. Initially, collar 118 will be held by the frozen water in the dashed line position shown. When the ice in cavity 28 melts, collar 118 will float. This will be observable by the user by viewing through transparent wall 124, and thus the user will be able to observe the duration and extent of the cooling effect provided.

Figure 5:
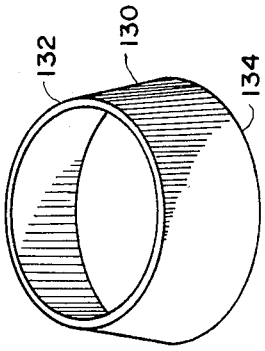
FIG. 5 is a pictorial view illustrating an alternate shaped floatable collar, in this instance, a truncated cone-shaped collar.

FIG. 5 illustrates a modification of the form of a collar (from that shown in FIGS. 1 and 2) wherein collar 130 is truncated, with its upper edge 132 being of a smaller diameter than its lower edge 134. Since there is basically an edge contact, there is little likelihood that collar 130 will stick to wall 34 through friction when it is desired to lower collar 130 for refreezing of liquid in cavity 28, which might otherwise be possible.

Figure 6:
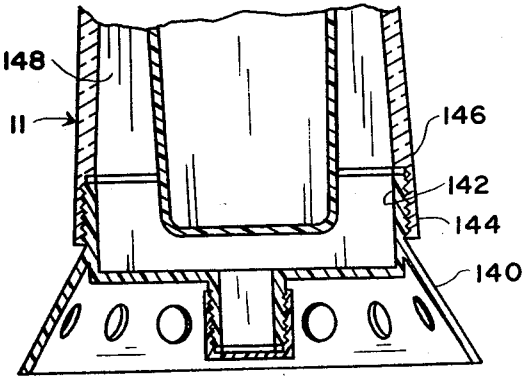
FIG. 6 is a partial sectional view similar to that shown in FIG. 2 except that this drawing illustrates a modification of the base of the vessel wherein the base is separable from the rest of the vessel.

FIG. 6 illustrates an embodiment of the invention as shown in FIGS. 1 and 2 wherein a removable base is provided. Base 140 has a threaded upper ring region 142 which mates with complementary threaded region 144 on a lower inner edge region of wall 146 of vessel 11. This modification facilitates a user placing in cavity 148 a collar or other figure of his own selection.

Figure 3:
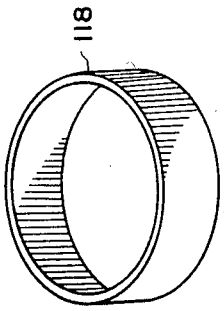
FIG. 3 is a pictorial view of a floatable collar member positionable within a cavity of a vessel as shown in FIG. 2.
Figure 8:
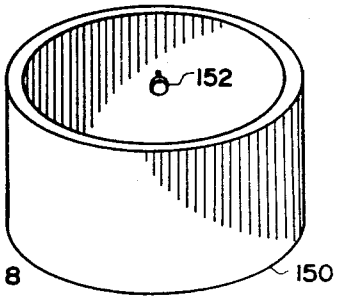
FIG. 8 is a pictorial view illustrating the cylindrical-shaped collar figure alone shown in FIG. 7.
Figure 7:
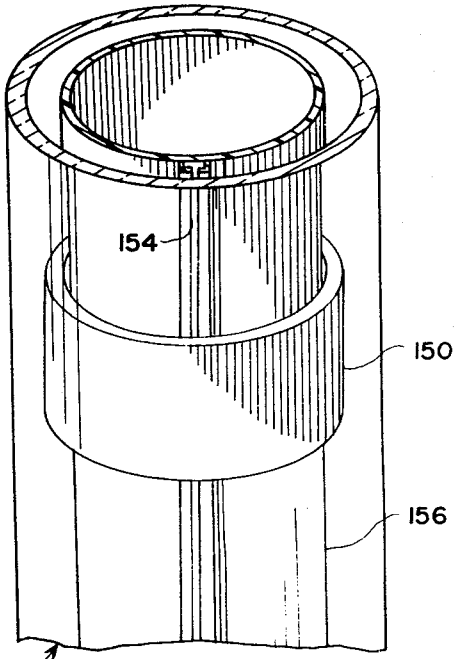
FIG. 7 is a partial pictorial view of a vessel illustrating the position of a cylindrical-shaped collar figure within a cavity between the inner and outer walls of the vessel, and further illustrating means for maintaining a fixed rotational position for the figure.

FIGS. 7 and 8 illustrate a further modified version of a collar 150 (to that shown in FIGS. 2 and 3). Thus, in this version, an inwardly extending pin member 152 of collar 150 is adapted to mate within a guide 154 extending vertically along the outside wall of tumbler 156 of vessel 15. In this embodiment, the wall of tumbler 156 is of a constant diameter. This modification prevents rotary movement of the collar, and thus hand motion of vessel 15 will not cause collar member 150 to be changed in its relative rotational position with respect to a handle (not shown) of the vessel. This thus would enable printed matter or a distinctive shaped design on or for collar 150 to be maintained in a fixed rotational position with respect to the handle and thus would be generally constantly viewable from a discrete side or sides of vessel 15.

FIG. 9 illustrates two distinctive sets of figures positioned within cavity 160 which may be used together or separately. One of the sets of figures, shown in FIG. 10, is constructed of a floatable ring to which is attached a series of letter-shaped FIGS. 162, in this instance, spelling "Go Team."

FIG. 11 illustrates a separate construction for a ring. In this case, ring 170 is of a split construction similar to the construction of a conventional key ring.

FIGS. 12 and 13 illustrate one mode of construction for forming letters to be hung on a ring wherein a small ring 172 with an opening 174 attaches to the upper side of a letter 176, in this case, a letter "C." The small ring 172 is adapted to slip on ring 170 of FIG. 11, being slipped through the split construction of ring 170.

FIGS. 14 and 15 illustrate an alternate form of construction for letter figures wherein the letter "A," designated by numeral 180, includes a hook 182 at the top of a letter. Thus, hook 182 would simply slip over a ring and would make unnecessary the split form of construction for a ring. The letter figures of FIGS. 12–15 would not necessarily need be of a floatable material, particularly where the basic ring structure as shown by ring 170 of FIG. 11 is of a floatable material.

The lower figure set 190 shown in FIG. 9 is also separately shown in FIG. 16. It depicts two football players 192 and 194 and a football 196 being passed between them. Player FIGS. 192 and 194 are formed of a floatable material and weighted by weights 198 so as to maintain the upright position shown and are interconnected by a semi-stiff piece of line 200, such as a monofilament fishing line. This enables the maintenance of the orientation and spacing of figures as shown.

Figure 17:
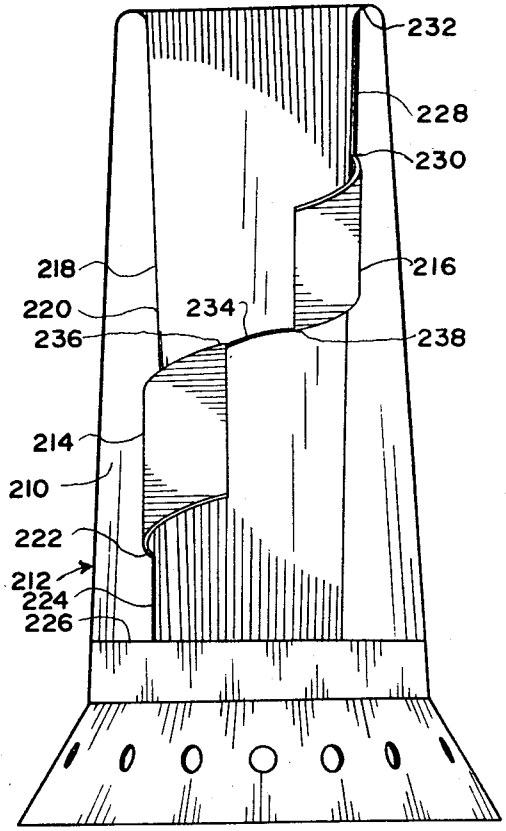
FIG. 17 is an elevational view of a vessel showing a pair of separate banner-like figures connected together and to the vessel by means of a relatively stiff connecting line.

FIG. 17 illustrates an embodiment of the invention wherein the figures within cavity 210 of vessel 212 comprise a pair of curved banners 214 and 216 extending around the outer wall 218 of tumbler 220 in cavity 210 at different elevations. The lower figure is anchored at a lower edge 222 by a relatively stiff line 224 connected to the bottom 226 of vessel 212, and the upper banner 216 is anchored by a stiff line 228 which connects from an upper edge 230 of banner 216 to an upper end 232 of vessel 212. Banners 214 and 216 are also connected to each other by a monofilament line 234 attached from upper edge 236 of banner 214 to lower edge 238 of banner 216. When not frozen, banners 214 and 216 can move, to a limited extend, principally inwardly and outwardly. Typically, desired letters or artwork would be placed on the banners.

As another feature of this invention, a colored fluid 250, such as a red fluid, is placed in cavity 28 (FIG. 2). This red fluid 250 is visible through transparent wall 124 and gives drinking vessel 10 a reddish appearance. Alternate colors may be used for colored fluid 250, such as orange, green, or yellow, depending upon the color desired. Colored fluid 250 is identical in operation to fluid 120 in that colored fluid 250 is refrigerated so as to chill or maintain a chilled beverage within tumbler 12.

Figure 18:
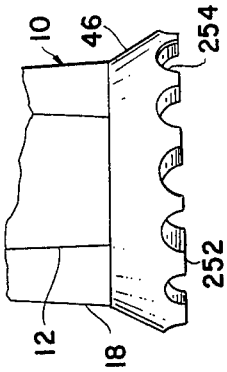
FIG. 18 is a broken away view of a lower portion of the drinking vessel.

FIG. 18 illustrates support base or skirt 46 having its lower surface 252 scalloped. This lower surface 252 is configured having a continuous series of circular segments 254 cut into it forming a lower border of skirt 46. These circular segments 254 serve the same function as spaced openings 50 previously described.

Referring now to FIG. 19, there is shown an alternate method of sealing drinking vessel 10. Flange 260 surrounds opening 36 and extends downward below this opening. Sealing plug 262 having tapered sides 264 is forcibly pressed against the inner surface 266 of depending flange 260. This effects a closure of opening 36, thereby sealing cavity 28.

Figure 20:
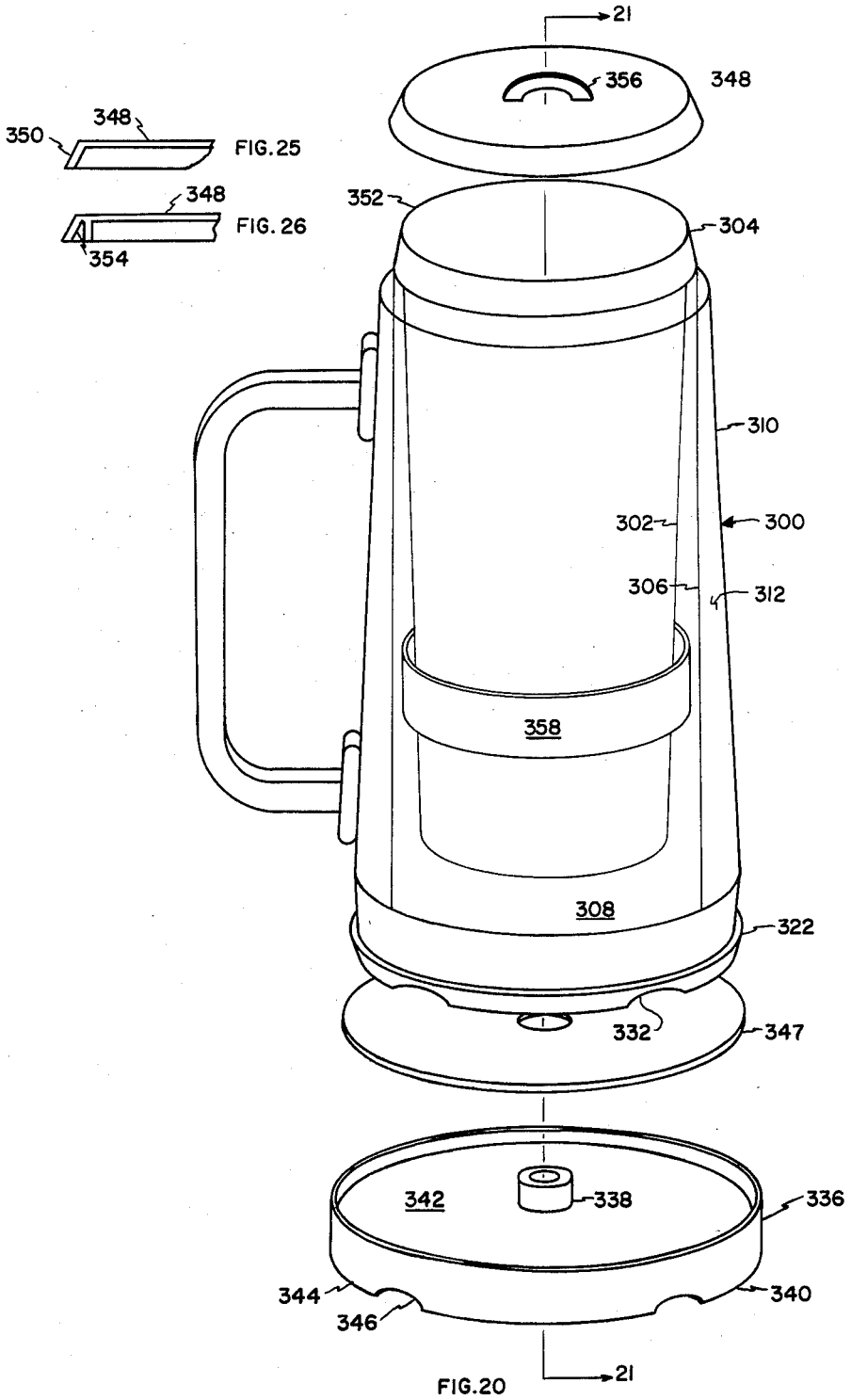
FIG. 20 is an exploded pictorial view of a drinking vessel.
Figure 21:
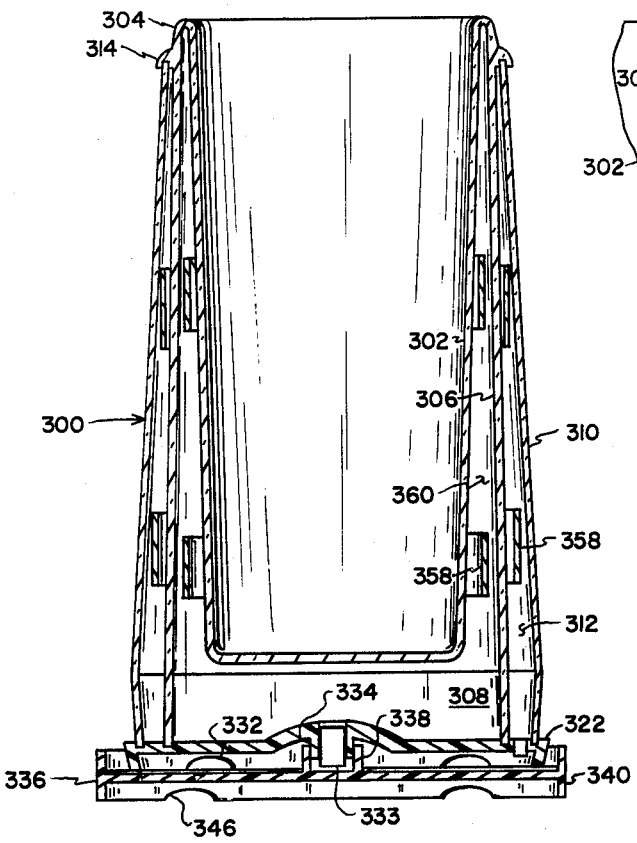
FIG. 21 is a sectional view taken along line 21—21 of FIG. 20.

Referring now to FIGS. 20 and 21, there is shown an exploded and a sectional view of drinking vessel 300 which is constructed similar to drinking vessels 10 and 11 previously described. Drinking vessel 300 includes tumbler 302 which is attached to the upper region 304 of inner wall 306, and cavity 308 is formed between tumbler 302 and inner wall 306. Outer wall 310 surrounds inner wall 306 and is secured to inner wall 306 adjacent upper region 304 thereby forming cavity 312 between them.

Figure 22:
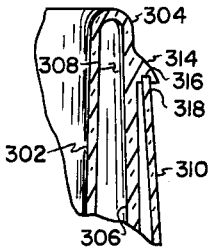
FIG. 22 is an enlarged pictorial view of a portion of FIG. 21 illustrating a method of construction.
Figure 23:
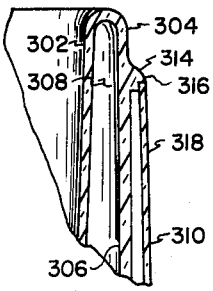
FIG. 23 is an enlarged pictorial view of a portion of FIG. 21 illustrating an alternate method of construction with respect to that shown in FIG. 22.

FIG. 22 is an enlarged view of a portion of FIG. 21 illustrating how outer wall 310 and inner wall 306 are joined. Upper region 304 of inner wall 306 is configured having an annular enlarged region 314 projecting outward from inner wall 306. Notch 316 is formed in enlarged region 314 and is sized to accept end 318 of outer wall 310 as shown. An alternate method of attaching outer wall 310 to enlarged region 314 is shown in FIG. 23. Outer wall 310 and inner wall 306 may be joined by ultrasonic welding, gluing or by some other means.

Figure 24:
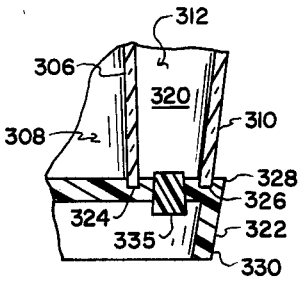
FIG. 24 is an enlarged pictorial view of a portion of FIG. 21 ilustrating a base detail.

The lower region 320 of inner and outer walls 306 and 310 are secured to base 322 as shown in FIG. 21. A pair of concentric circular grooves 324 and 326 are notched in base 322, and these grooves 324 and 326 are sized to accept inner and outer walls 306 and 310, respectively (FIG. 24). The outer periphery 328 of base 322 is configured having a downwardly extending lip 330, and this lip contains notches 332 therein to enable air to flow underneath base 322. Interior of lip 330 is male coupling member 334 which extends downward from base 322. Male member 334 may be formed as a part of base 322 (as shown) or it may be part of a plug 333 inserted into base 322 to seal cavity 308. Male member 334 projects downward flush with lip 330, enabling drinking vessel 300 to be supported on a flat surface by base 322.

Coaster 336 is configured having female coupling members 338 which couples with male member 334 of base 322. When members 334 and 338 are coupled, coaster 336 is secured to drinking vessel 300 and is moved with it. Coaster 336 has an exterior lip 340 that extends above and below vessel supporting surface 342 of coaster 336. The lower region 344 of lip 340 has notches 346 therein to enable air to flow underneath coaster 336.

Blotter 347 is secured around female coupling member 338 interior of lip 340 and between coaster 336 and base 322. Blotter 347 absorbs any condensate collected by coaster 336, and when blotter 347 becomes saturated, it may be removed and either replaced or dried.

Top 348 of vessel 300 is sized to fit over and seal tumbler 302. Top 348 may be configured as shown in FIG. 25 where lip 350 fastens around rim 352 or top 348 may be configured as shown in FIG. 26 where rim 352 fits within notch 354. Additionally, top 348 may be a plug-type stopper that is pressed into tumbler 302. Handle 356 is secured to top 348 and aids in the removal of top 348 from tumbler 302.

Referring now to FIG. 21, either of cavities 308 and 312 may be filled with a refrigerant, such as salt water, to maintain the temperature of that contained in tumbler 302. Ideally, cavity 308 would be filled with a refrigerant, and cavity 312 would be a dead air space. Alternately, both cavities 308 and 312 may be filled with refrigerant or both cavities may act as dead air spaces for insulative purposes. Regardless of what is contained within cavities 308 and 312, they may be permanently sealed or plugs 333 and 335 may be inserted in openings in base 322, permitting access to these cavities.

Annular ring 358, similar to ring 118 or FIG. 190 previously described, and having a density different from that of water, is positioned within either of cavities 308 and 312 as shown in FIG. 21. Ring 358 is sized to be longitudinally movable within its cavity around tumbler 302. Ring 358 may have decorative markings on it or ring 358 may be decoratively configured, and more than one ring may be inserted in each cavity as shown.

Generally, ring 358 would be inserted into a cavity that is also filled with fluid 360, such as salt water, and then vessel 300 would be refrigerated to cool and/or freeze fluid 360. The density of fluid 360 may be varied such as by adding or subtracting salt from it, and the density of fluid 360 will affect the floating or sinking characeristics of ring 358.

During operation, vessel 300 would be cooled in an upside down position such that, should fluid 360 freeze, it would freeze beginning adjacent region 304 of inner wall 306 and proceed toward up-ended base 322 of vessel 300. Should ring 358 be of a density less than that of fluid 360, when vessel 300 is up-ended for cooling, ring 358 would rise toward base 322 and be held there as fluid 360 freezes. Then, later during use of vessel 300, as fluid 360 melts, ring 358 would float upward toward upper region 304 of inner wall 306, thereby indicating the degree to which fluid 360 has melted. Alternately, should ring 358 be of a density greater than that of fluid 360, when vessel 300 is up-ended for freezing, ring 358 would move downward and be trapped adjacent upper region 304 of inner wall 306 by the frozen fluid. Later, as vessel 300 is uprighted and used, the melting of fluid 360 would enable ring 358 to drop and move closer to base 322. Thus, as ring 358 approaches base 322, the amount of fluid 360 that has melted can be determined.

Additionally, two rings could be inserted within a cavity with one ring being heavier than the surrounding fluid and the other ring being lighter than the surrounding fluid such that, when vessel 300 is frozen in an upsidedown position and then uprighted for use, these rings would move toward each other as the fluid melts. Thus, one could visually determine the cooling abilities of vessel 300 by noting the position of one or more rings 358.

Vessel 300 may be welded, glued, press fitted, or otherwise constructed so as to provide leak-free cavities 308 and 312 and a sturdy vessel 300.

What is claimed is:

1. A drinking vessel assembly comprising:

a circular-shaped tumbler;

a first wall surrounding the sides of and extending below said tumbler, said first wall being spaced from said tumbler, and a top of said tumbler and said first wall being sealably connected;

a second wall concentric with and spaced outwardly from said first wall, and a top of said second wall being sealably connected to said first wall;

a base extending across and closing a lower end of said first and second walls, said base being spaced from the bottom of said tumbler thereby defining a first cavity between said tumbler, said first wall and said base, and defining a second cavity between said first wall, said second wall and said base;

a fluid partially filling said first cavity;

a lip attached to and extending down from an outer region of said base to a lower edge forming a support for said assembly;

a series of spaced openings around and through said lip, enabling air circulation under said base of said container; and a handle attached to the side of said second wall.

2. An assembly as set forth in claim 1 further comprising a coaster removably coupled to said base of said drinking container.

3. An assembly as set forth in claim 2 wherein said coaster includes a blotter member secured between said coaster and said base of said drinking container.

4. An assembly as set forth in claim 2 wherein said coaster is configured having a peripheral second lip including upward and downward extension regions, said downward extension region having a series of spaced openings therethrough enabling air circulation underneath said coaster.

5. An assembly as set forth in claim 1 further comprising at least one discrete figure positioned within one of said containers.

6. An assembly as set forth in claim 5 wherein a said figure is positioned within said first cavity.

7. An assembly as set forth in claim 5 wherein a said figure is positioned within said second cavity.

8. An assembly as set forth in claim 1 further comprising at least one filling member positioned on said base and having an opening through said base, and comprising at least one closure adapted to mate with and sealably close said filling member.

9. An assembly as set forth in claim 5 wherein said figures have a density different from that of water.

* * * * *